US005257693A

United States Patent [19]

Kwasniak

[11] Patent Number: 5,257,693

[45] Date of Patent: Nov. 2, 1993

[54] DRUG DRAWER TRAY

[76] Inventor: Diane Kwasniak, 515 Lincoln Ave., Willow Grove, Pa. 19090

[21] Appl. No.: 914,851

[22] Filed: Jul. 15, 1992

[51] Int. Cl.[5] ..... B65D 6/16

[52] U.S. Cl. ..... 206/232; 206/570; 206/818; 220/666; 312/209; 312/348.3

[58] Field of Search ..... 206/232, 438, 459.5, 206/528, 534, 538, 539, 558, 561, 570, 818; 220/8, 666; 312/205, 209, 348.3

[56] References Cited

U.S. PATENT DOCUMENTS

| | | | |
|---|---|---|---|
| 1,480,537 | 1/1924 | Heller | 206/459.5 |
| 2,115,021 | 4/1938 | Joffee | 206/459.5 |
| 2,530,220 | 11/1950 | Belcher | 312/209 |
| 2,907,487 | 10/1959 | Harrington | 220/8 |
| 3,145,841 | 8/1964 | McGuire | 206/459.5 |
| 3,463,343 | 8/1969 | Asenbauer | 220/8 |
| 3,572,536 | 3/1971 | Wehner | 220/8 |
| 3,708,709 | 1/1973 | Morrison et al. . | |
| 3,834,778 | 9/1974 | Morrison et al. . | |
| 3,887,102 | 6/1975 | Earley | 220/8 |
| 4,019,793 | 4/1977 | Gerding . | |
| 4,065,021 | 12/1977 | Kedzierski . | |
| 4,114,965 | 9/1978 | Oye et al. . | |
| 4,127,311 | 11/1978 | Weiman . | |
| 4,363,402 | 12/1982 | Grzyll | 206/818 |
| 4,588,237 | 5/1986 | Marder . | |
| 4,593,819 | 6/1986 | Will | 206/53 X |
| 4,652,062 | 3/1987 | Greenwood . | |

*Primary Examiner*—Jimmy G. Foster

*Attorney, Agent, or Firm*—Steve Mendelsohn; William H. Murray

[57] ABSTRACT

The apparatus comprises rectangular male and female sections having two tongues and two grooves, respectively, for adjusting the length of the apparatus. A plurality of permanent and removable dividers are positioned within the male and female sections to form a plurality of compartments within the apparatus. There are labeling means attached to the removable dividers for labeling the compartments. On the bottom of the apparatus are attached one or more magnetic feet.

1 Claim, 7 Drawing Sheets

DRUG DRAWER TRAY

FIELD OF THE INVENTION

The present invention relates to the field of storage devices for solid objects, and in particular, to a drawer tray for storing and organizing drugs and equipment used by anesthesiologists in operating rooms.

BACKGROUND OF THE INVENTION

In typical operating rooms, anesthesiologists use a wide variety of drugs, needles, syringes, and other small equipment during patient operations. An anesthesiologist must have ready and efficient access to this variety of drugs and equipment under the pressure and time constraints imposed during these operations. Anesthesiologists use anesthesia drug and supply carts with drawers that are supposed to store, consolidate, and organize these many items needed to perform their tasks. Since space is usually very limited and the number and variety of supplies is continually increasing, maximal utilization of space is of critical importance.

Typically, anesthesiologists use commercial drawer dividers to store and organize their drugs and equipment. Unfortunately, these drawer dividers do not meet the many specific needs of anesthesiologists. All of the commercial drawer dividers are too small. Since they are too small, they waste space within the drawer and slide around inside the drawer. None of them have enough compartments for storing the number and variety of anesthesiologist supplies, and the size of the compartments that are provided are not appropriate for the storing many of the supplies used by anesthesiologists.

The results are wasted and underutilized space, sliding and mixing of supplies, disorganization and interference with smooth and efficient functioning of the anesthesiologist. In addition, because of the inefficient drawer organization, the supplies need to be restocked frequently.

SUMMARY OF THE INVENTION

The present invention relates to a drug drawer tray for storing the drugs and equipment used by anesthesiologists during operations. The drug drawer trays fit into the drawers of anesthesia drug and supply carts. In order to accommodate supplies of varying size and quantity, the dividers of the drug drawer tray are removable to allow users to alter the number and size of compartments contained in the drug drawer tray.

Each divider contains a label slot to identify or otherwise indicate the supplies stored in the particular compartments. The label slot is at the top side of the divider to provide easy reading of the label and to prevent obstruction or damage to the label that would otherwise result from spilling of liquids within the compartments.

In addition, the drug drawer tray is expandable to fit more snugly into cart drawers of varying dimension and to utilize more efficiently the space available within the drawers. The drug drawer tray also contains magnetic feet to prevent slipping of the tray within the drawer.

DETAILED DESCRIPTION OF THE INVENTION

Figure 1:
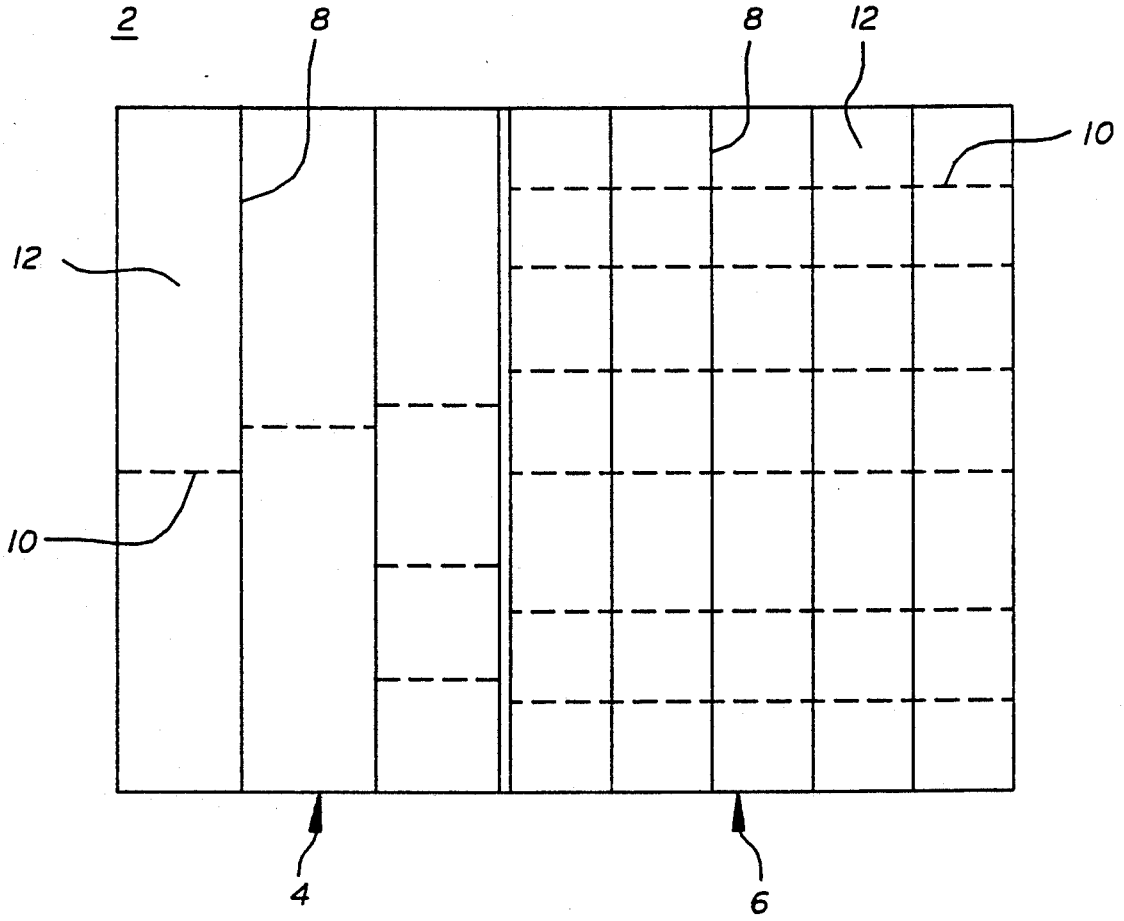
FIG. 1 is a plan view of the drug drawer tray of the present invention.
Figure 2:
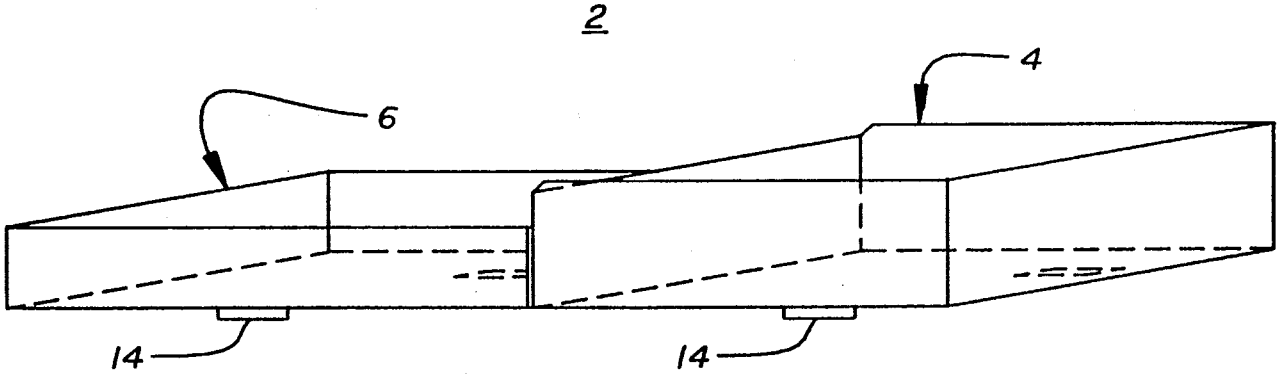
FIG. 2 is a perspective view of the drug drawer tray of the present invention.

Referring now to FIGS. 1 and 2, there are shown a plan view and a perspective view, respectively, of drug drawer tray 2 of the present invention. Drug drawer tray 2 includes "male" section 4 and "female" section 6. Both male section 4 and female section 6 contain permanent dividers 8 and removable dividers 10. Permanent dividers 8 and removable dividers 10 combine to form compartments 12. Drug drawer tray 2 also includes magnetic feet 14 positioned on the bottom of male section 4 and female section 6. Removable dividers 10 may be removed from drug drawer tray 2 to alter the size and number of compartments 12 of drug drawer tray 2.

Figure 4:
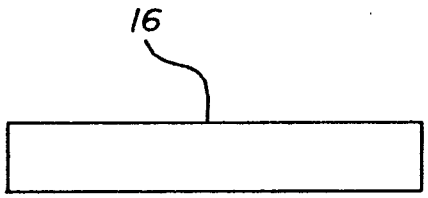
FIG. 4 is a side view of a label of the drug drawer tray of the present invention.
Figure 3:
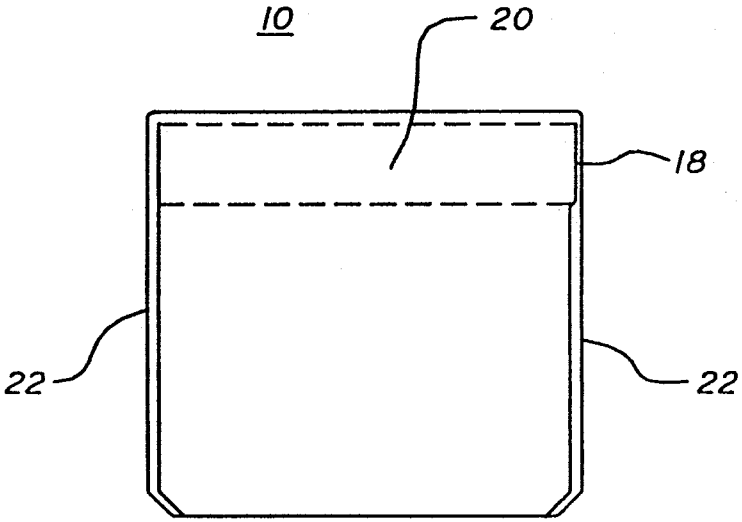
FIG. 3 is a side view of a divider of the drug drawer tray of the present invention.

Referring now to FIGS. 3 and 4, there are shown a side view of removable divider 10 and a side view of label 16, respectively, of drug drawer tray 2 of the present invention. Removable divider 10 contains slot 18, transparent window 20, and edges 22. Label 16 may be annotated with markings to identify the contents of compartment 12 defined by removable divider 10. Label 16 slides into slot 18 and can then be viewed through transparent window 20.

Figure 6:
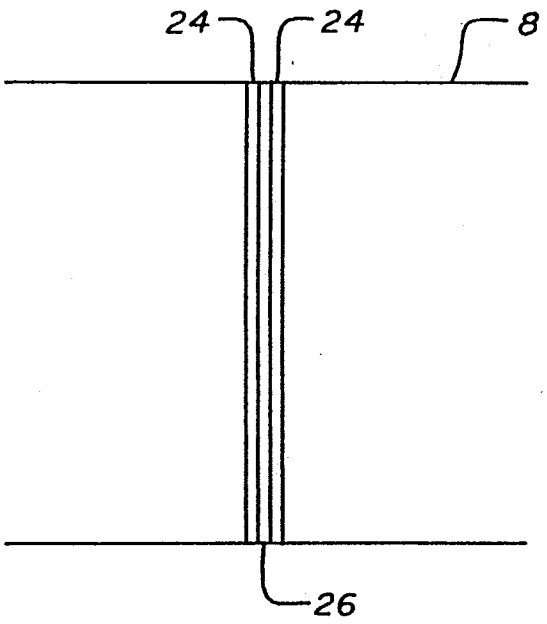
FIG. 6 is a side view of a portion of the interior of the drug drawer tray of the present invention.
Figure 5:
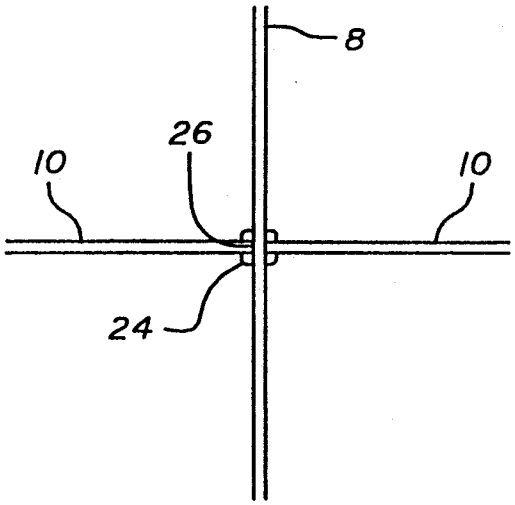
FIG. 5 is a plan view of a portion of the drug drawer tray of the present invention.
Figure 7:
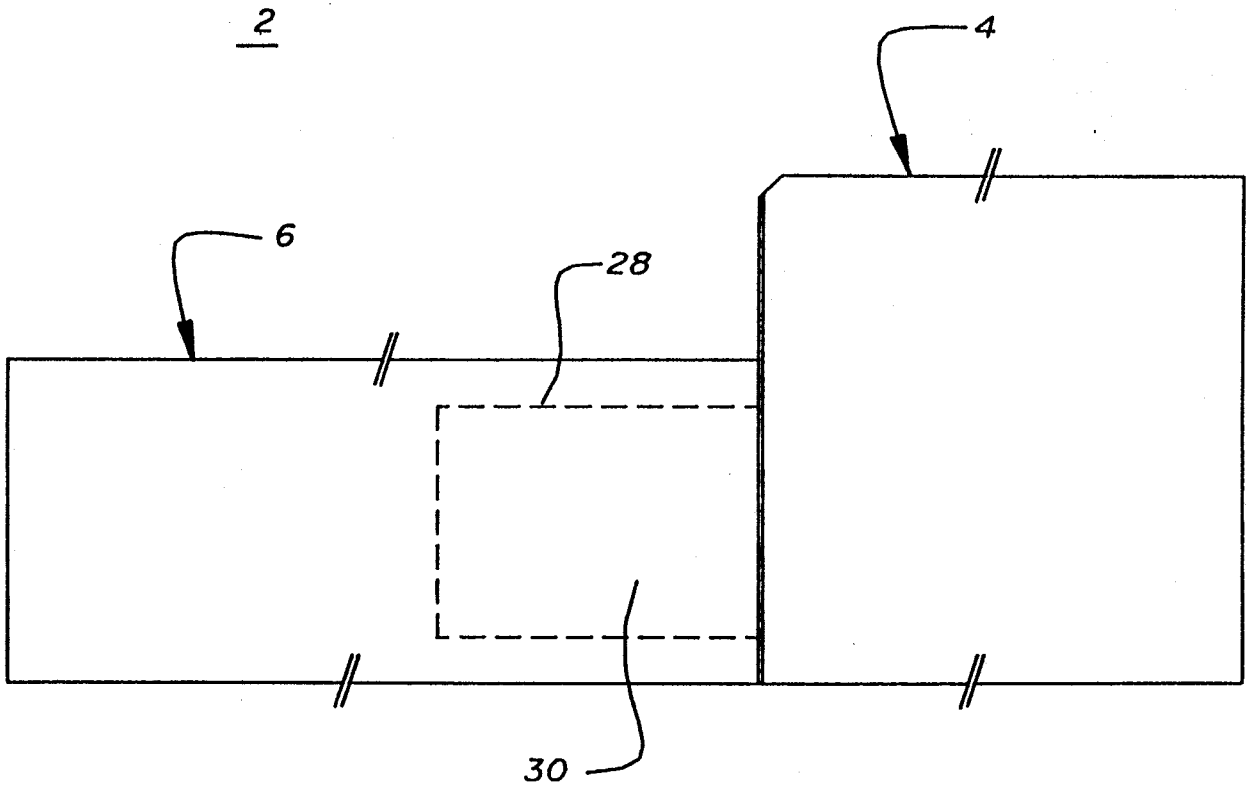
FIG. 7 is side view of the drug drawer tray of the present invention showing internal features.
Figure 8:
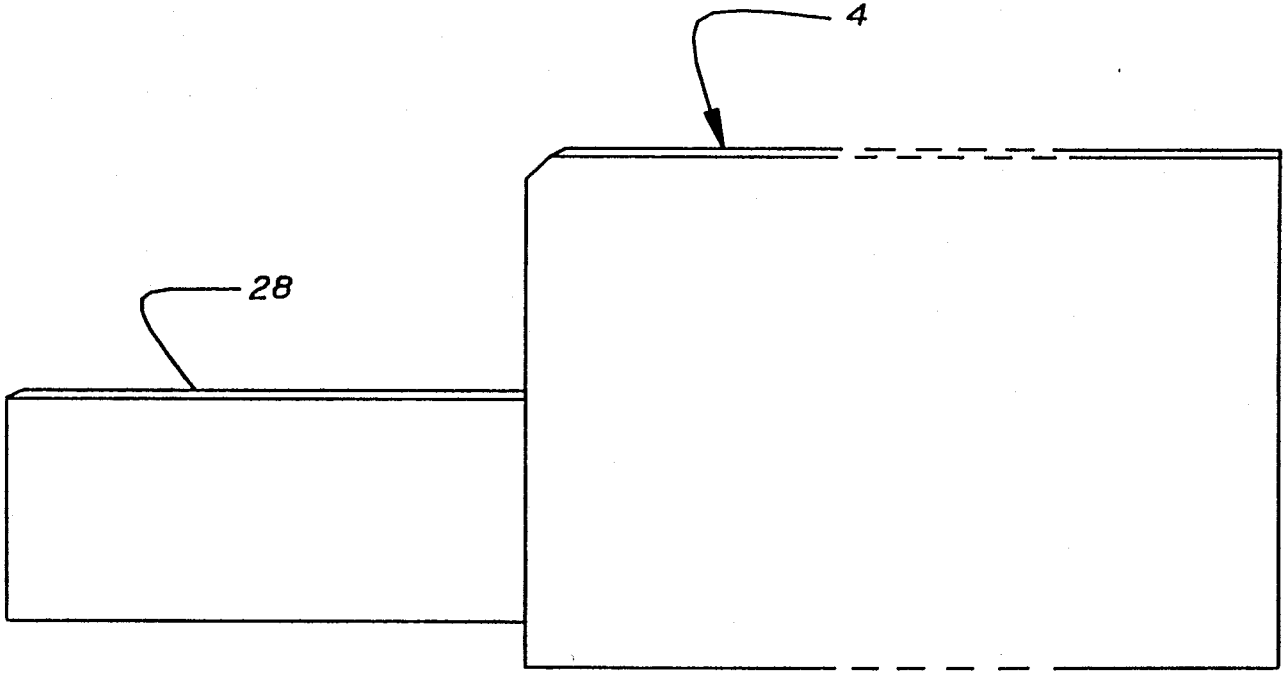
FIG. 8 is a side view of the "male" section of the drug drawer tray of the present invention.
Figure 10:
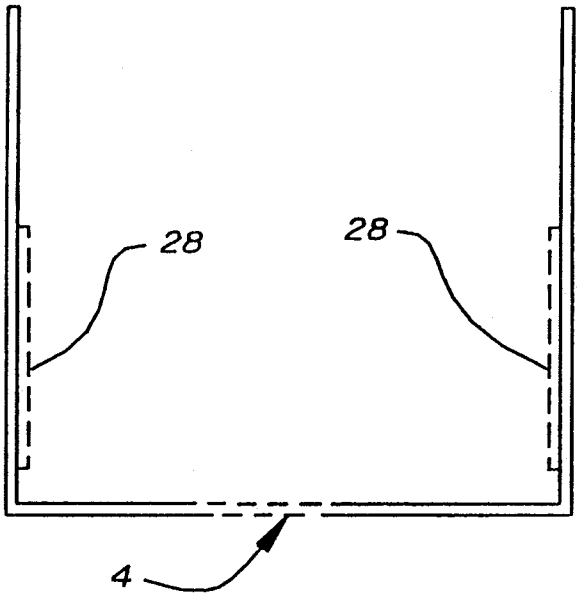
FIG. 10 is an end view of the "male" section of the drug drawer tray of the present invention.
Figure 9:
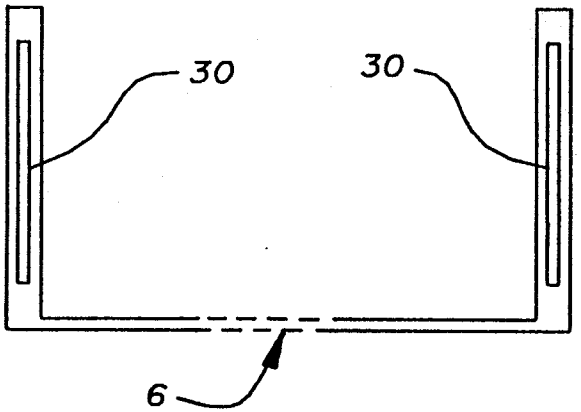
FIG. 9 is an end view of the "female" section of the drug drawer tray of the present invention.

Referring now to FIGS. 5 and 6, there are shown a plan view and a side view, respectively, of a portion of the interior of drug drawer tray 2 of the present invention. In these figures are shown permanent divider s and removable dividers 10. Ribs 24 are attached to permanent divider s to form channels 26. Edges 22 of removable dividers 10 slide between ribs 24 to fit into channels 26 of permanent divider 8.

Referring now to FIG. 7, 8, 9, and 10, there are shown a side view of male section 4 and female section 6 together, a side view of male section 4, an end view of female section 6, and an end view of male section 4, respectively, of drug drawer tray 2 of the present invention. Male section 4 includes tongues 28, and female section 6 includes grooves 30. Tongue 28 of male section 4 slides within groove 30 of female section 6. The position of male section 4 with respect to female section 6, that is, the length of tongue 28 within groove 30, may be adjusted to vary the length of drug drawer tray 2.

Drug drawer tray 2 fits inside a drawer of anesthesia drug and supply carts (not shown) used by anesthesiologists in operating rooms. The length of drug drawer tray 2 may be controlled to fit snugly inside the drawer by adjusting the length by which tongues 28 of male section 4 are inserted into grooves 30 of female section 6. When the drawer is metal, the magnetic feet 14 keep drug drawer tray 2 from sliding around within the drawer.

Drug drawer tray 2 may be used to store anesthesia drugs and supplies of various sizes and quantities. The size and number of compartments 12 may be adjusted to accommodate these drugs and supplies by inserting removable dividers 10 into selected channels 26 of drug drawer tray 2. Label 16 disposed within slot 18 of transparent window 20 of removable divider 10 may be inscribed with the name of the specific drug and supply stored within compartment 12. An anesthesiologist or assisting nurse would then be able to identify and select the required drug or supply with speed and accuracy.

The drug drawer tray of this invention provides more space for storage, promotes better organization and efficiency, and allows better concentration on the tasks at hand. It also reduces the time and frequency involved in preparation and restocking of the supplies for future operations.

It will be understood that various changes in the details, material, and arrangements of the parts which have been described and illustrated in order to explain the nature of this invention may be made by those skilled in the art without departing from the principle and scope of the invention as expressed in the following claims.

What is claimed is:

1. An apparatus for storing objects in an organized manner, comprising:

(a) a rectangular male section having two tongues extending from opposite sides of one end of said male section;

(b) a rectangular female section having two grooves at opposite sides of one end of said female section, wherein said tongues of said male section are slidably disposed within said grooves of said female section, wherein the length of said apparatus may be adjusted by sliding said tongues within said grooves;

(c) a plurality of permanent dividers disposed within said male and female sections and aligned parallel to and equidistant from one another;

(d) a plurality of removable dividers removably positioned within said male and female sections and aligned perpendicular to said permanent dividers, wherein the walls of said male and female sections, said permanent dividers, and said removable dividers define a plurality of compartments;

(e) labeling means attached to said removable dividers for labeling said compartments; and (f) four magnetic feet disposed on the bottom of said apparatus.

* * * * *